US005085388A

United States Patent [19]

Creutz

[11] Patent Number: 5,085,388

[45] Date of Patent: Feb. 4, 1992

[54] HOLDER WITH ADJUSTING BODY, IN PARTICULAR FOR SPECTACLE FRAMES, SPECTACLE MOUNTING FRAMES OR THE LIKE

[76] Inventor: Hans-Werner Creutz, Wittelsbacher-Strasse 48, D-5040 Brühl, Fed. Rep. of Germany

[21] Appl. No.: 567,945

[22] Filed: Aug. 15, 1990

[30] Foreign Application Priority Data

Mar. 6, 1990 [DE] Fed. Rep. of Germany ... 9002566[U]

[51] Int. Cl.[5] ..... A47F 7/00

[52] U.S. Cl. ..... 248/288.5; 248/206.5; 248/902; 403/115

[58] Field of Search ..... 248/902, 206.5, 288.3, 248/288.5; 403/115, 116, 114, 130, 131

[56] References Cited

U.S. PATENT DOCUMENTS

| | | | |
|---|---|---|---|
| 773,973 | 11/1904 | Palmenberg | 248/288.3 |
| 777,996 | 12/1904 | Applegate | 248/288.3 |
| 807,857 | 12/1905 | Palmenberg | 248/288.3 X |
| 1,166,752 | 1/1916 | Finizio | 403/130 X |
| 2,322,081 | 6/1943 | Wright | 403/130 |
| 2,948,500 | 8/1960 | Kuhn | 248/902 X |
| 3,291,429 | 12/1966 | Neanhouse | 248/902 X |
| 3,409,317 | 11/1968 | Richards | 403/115 X |
| 3,552,701 | 1/1971 | Montagano | 248/902 X |

FOREIGN PATENT DOCUMENTS

| | | | |
|---|---|---|---|
| 187818 | 11/1936 | Switzerland | 248/288.3 |

*Primary Examiner*—David L. Talbott

*Attorney, Agent, or Firm*—Pearner, Gordon, McCoy & Granger

[57] ABSTRACT

There is disclosed a holder with an adjusting body for displaying spectacle frames or for receiving a mounting frame for displaying spectacle frames comprising a housing on which the adjusting body is steplessly adjustable in three dimensions, for example using a clampable ball joint.

15 Claims, 2 Drawing Sheets

HOLDER WITH ADJUSTING BODY, IN PARTICULAR FOR SPECTACLE FRAMES, SPECTACLE MOUNTING FRAMES OR THE LIKE

BACKGROUND OF THE INVENTION

1. Field of the Invention

The invention relates to a holder in particular for spectacle frames, spectacle mounting frames or the like, having an adjusting body and a holder housing, designed for the presentation or display of such articles in retail establishments 2. Summary of the Prior Art Spectacle frames are currently presented for sale purposes either on a support, such as may be used in a shop window, lying in a glass case or on, for example, shelves arranged on a wall. In every case the spectacle frame in the display takes up an angular position dependent on the support or mount, and often this position is not ideal for inspection. For a close examination of a frame, it has to be taken from the support or mount and must be presented to the customer by hand.

Furthermore a presentation of spectacle frames in the form and manner described above requires as a consequence a large amount of space.

In order to counter the drawbacks which have arisen with these arrangements, it is known to employ a holder for spectacle frames which has a receiving socket and a foot for supporting the socket and for securing the holder to a support. However this holder, after attachment to a support, only offers limited possibility for positioning and accordingly a limited possibility for presentation of the spectacle frame.

A further point is that the known holder takes up a relatively large amount of space so that difficulties arise when attaching it to the smallest supports.

SUMMARY OF THE INVENTION

The object of the invention is to provide a holder with an adjusting body, in particular for spectacle frames, spectacle mounting frames or the like, in which a spectacle frame can be located securely for presentation. Furthermore, it is an object that the holder is constructed so that it does not interfere with the presentation of the frame and moreover offers the possibility of being able to display the frame in a multitude of possibilities of adjustment of the holder in what is always the optimum position and orientation for display.

This problem is solved by a holder having an adjusting body of the kind stated in the introduction and having the adjusting body arranged to be adjustable in three dimensions. Further advantageous features of the invention form the subject of the subsidiary claims.

By virtue of the fact that the adjusting body is adjustable in three dimensions it is possible to locate a spectacle frame secured to the holder or a spectacle mounting secured to the holder in a stepless manner into different angular positions so that the spectacle frame can always be presented in the optimum position independently of the position of the support. In this way the possibility is provided that the frame to be displayed can be shown in a multitude of different positions without the holder or indeed the support having to be altered by constructional or non-constructional steps, and without it even being necessary to introduce different kinds of holder. The holder according to the invention can accordingly be adjusted in three dimensions so that the spectacle frame can be displayed freely adjustably in the greatest possible number of different positions on a wall or on another support.

If the adjusting body is arranged to be adjustable in a stepless manner, at least in and between two planes, the possibility is thereby provided for being able to position the object to be displayed in an almost unlimited number of ways.

By virtue of the ability to clamp the adjusting body the result is achieved that no further auxiliary means are necessary for presenting the article such as a spectacle frame. The frame can be shown to interested parties free of disturbing influences dictated by technical requirements.

If the adjusting body comprises a receiving socket for receiving the end of, for example, at least one ear piece of a spectacle frame or for receiving a spectacle mounting frame, and if the adjusting body is made of resiliently yielding material, the result is that a spectacle frame mounted on the holder according to the invention can not only be removed without difficulty but at the same time in order to do this a certain amount of care is necessary. This militates against unauthorised removal of spectacle frames. The end of, for example, an ear piece of a spectacle frame introduced into the receiving socket is, in such an arrangement, retained securely in the adjusting body by the form of the adjusting body, i.e. by frictional engagement. Moreover the construction according to the invention means that no further auxiliary means are required, i.e. that no separation is present between the receiving socket and the adjusting body. The holder according to the invention is thus extremely compact and favourably shaped.

If the adjusting body is also provided with a mounting frame, on which a spectacle frame can be mounted, it is possible to display spectacle frames in the opened-out condition so that the customer can, for example, look at both ends of the ear piece simultaneously.

By the provision of a foot on the housing of the holder, designed to be attached to a support, an extremely compact form of construction is obtained, with no separation between the functions of retention and attachment.

If the foot is arranged within the housing of the holder and is in screwed engagement with the housing, then, even under extreme conditions and after long periods of use, no fatigue problems appear in the material leading to separation of the foot from the housing.

If the foot is provided with a permanent magnet in the region of its engaging face, the holder can be arranged in any desired position on a suitably disposed metallic support and can be shifted as required without needing any special further technical steps. A suitable support can for example be a metal sheet with a coating of paint or plastics. Such coatings offer an external appearance which is advantageous and attractive for retail selling points.

By making the adjusting body in the form of a pivot or ball joint there is obtained a form of construction which is notable for its convenience and low wear. The effective operation of the holder according to the invention is maintained even over long periods.

In one arrangement, the ball joint is a ball arranged in the housing of the holder, and the housing is of frustoconical shape at least at its upper end (i.e. the end opposite the engaging surface of the foot). The housing has, at its upper end, an opening which at least partially exposes the ball, and at least the inner edges of this opening in the housing engage the surface of the ball. The ball joint is thus formed by the housing of the holder and the adjusting body themselves so that even here no particular constructional techniques are required and holder is of compact construction.

The ball is engaged by that face of the foot which is opposite its mounting face, allowing the ball joint to be clamped in position.

In one possible arrangement, the housing has a notch cut through its wall, leading from the rim of the opening which exposes the ball. This makes the ball adjustable not only over the region of the upper opening but also in the region of the notch so that a further degree of adjustability is achieved.

Not only the actual articles to be displayed, such as spectacle frames, spectacle accessories, price tags, company names or logos, but also descriptions of the goods and many other things may be mounted on the holder according to the invention.

In such an arrangement it is possible to provide a detachable connection, e.g. of a spectacle holder frame. It is also possible to provide a permanent connection, i.e. so that the holder has a spectacle holder frame as a further permanently attached component.

Moreover it is possible to construct the holder in such a way that it is suitable for the insertion of both of the ear pieces of a spectacle frame. Furthermore, if the holder is constructed to allow the insertion of the ear pieces of a number of spectacle frames, they could be displayed in a special decorative mutual relationship, for example in a star pattern.

BRIEF DESCRIPTION OF THE DRAWINGS

Two embodiments of the holder according to the invention are illustrated in the drawings, in which.

DETAILED DESCRIPTION

Figure 1:
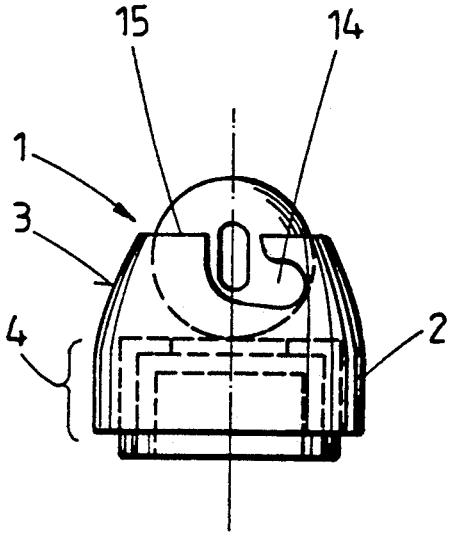
FIG. 1 is a front elevation of the holder with the opening disposed vertically.

The first embodiment to be described by way of example, illustrated in FIG. 1, of a holder 1 for spectacle frames comprises a housing 2 which is of frusto-conical shape in its upper region, its sides 3 in the upper region being arcuate. Over its lower portion 4 the housing 2 is cylindrical and provided with an internal screw thread 5 illustrated in FIG. 3. A threaded ring 6 is screwed into the lower part 4 of the housing 2.

Figure 3:
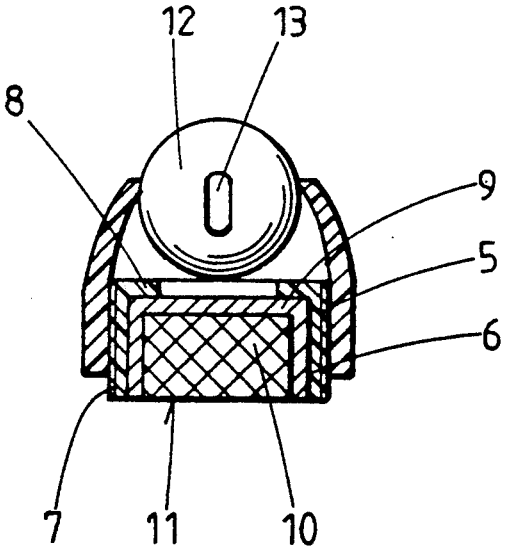
FIG. 3 is a section on the line A—A in FIG. 1.

The threaded ring 6 has on its upper end a circular closure ring 8 integral with its side wall 7 and co-axial with its central axis, whilst it is open at its lower face as shown in FIG. 3. In the interior of the threaded ring 6 there is arranged a downwardly open metal shell 9, the upper face of which engages against the underside of the closure ring 8 and is held by friction within the threaded ring 6. The ring 6 and the metal shell 9 in this first embodiment form the foot 16 of the holder 1.

It would also be possible to envisage making the metal shell 9 of closed shape and providing an adhesive layer on its lower face.

Likewise it is possible to form the upper end of the threaded ring 6 without an opening, i.e. to make it of closed shape and/or to provide lugs on its lower end to retain the metal shell 9.

In the embodiment discussed here, a permanent magnet 10 is provided inside this metal shell 9 and it terminates flush with the lower face of the shell 9. The magnet 10 and the lower face of the shell 9 form a common surface 11. This is an engaging surface by which the holder 1 can be mounted on a support, not shown, and can thereby be held on it, provided that the support is of ferromagnetic material or contains ferromagnetic inserts.

Above the metal shell 9 in the housing 2 of the holder there is a ball 12. The ball is in contact with the upper face of the shell 9 and is pressed by it, when the foot 16 is screwed in, against the inner wall of the upwardly (as shown in FIG. 3) open housing 2, and particular against the inner edges of the opening 22 in the housing. Thus, the upper part of the ball 12 projects from the substantially frusto-conically shaped housing 2.

As shown in FIGS. 1 to 5, the ball 12 has an opening 13 extending into it. The opening 13 defines a passage in the ball 12, and the depth of the passage can vary and can extend over almost the entire diameter of the ball 12.

Figure 2:
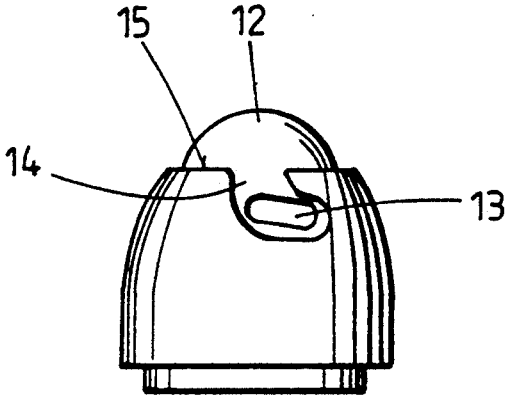
FIG. 2 is a front elevation of the holder with the opening inclined.

Moreover, as illustrated in FIGS. 1 and 2, the housing 2 has a nose-shaped or dog-leg notch 14 that extends initially from the upper edge 15 of the housing 2 in a direction inclined to the central axis, and to the right as viewed in FIG. 1, and then merges into a horizontal portion, as viewed in FIGS. 1 and 2, forming overall an elongate curved slot. The ball 12 can thus be moved to a position shown in FIG. 2 in which the opening 13 is in alignment with the notch 14.

The threaded ring 6 and the metal shell 9 form the foot 16 of the holder 1 which, in the first embodiment illustrated here, is equipped with a permanent magnet 10. By rotation of the threaded ring 6, this foot 16 can be displaced vertically, as viewed in FIG. 1. By an appropriate movement of the position of the threaded ring 6 towards the ball 12, the ball is pressed against the inner wall of the upper edge 15 of the housing 2 and is thus secured against rotation, i.e. locked in position.

Downward vertical movement of the foot 16, i.e. in a direction away from the ball 12, frees the ball and allows adjustment or rotation of it, complete with the opening 13 present in it.

In the embodiment under consideration the housing 2 and the threaded ring 6 could be made, for example, of plastics. Likewise the shell 9 which receives the magnet 10 could be produced from plastics.

The ball 12 having the opening 13 is made from a resiliently yielding material, such as soft plastics or rubber.

Figure 4:
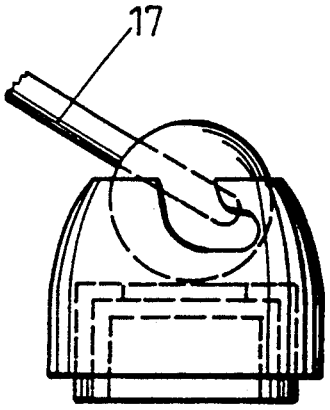
FIG. 4 is a front elevation of the holder with an end of an ear piece of a spectacle frame inserted in the opening.

As shown in FIG. 4, the end 17 of an ear piece of a spectacle frame (not illustrated further) can be inserted in the opening 13 in the ball 12 in such a way that a frictional connection is made between the ear piece and the material 12 of the ball. Specifically, the ear piece connects with the wall of the opening in the interior of the ball 12.

By virtue of the permanent magnet 10 in the foot 16 the holder 1 shown in the drawing can be mounted on a suitably placed support in any desired arrangement and orientation.

The rotatability of the threaded ring 6 in the housing 2 makes it possible to adjust the engaging pressure between the inner wall of the upper edge 15 of the opening 22 in the housing and the upper face of the metal shell 9. The pressure may be varied in such a way that the ball 12, and with it the opening 13, can be tilted or turned in the housing 2 (i.e. is movable in three dimensions) so that the spectacles which are secured in the opening 13 can be adjusted to any one of many different positions. The ability to move the ball, in combination with the possibility of mounting the foot 16 on its support in any desired position, results in an almost unlimited range of possible orientations of the article inserted in the ball 12.

Moreover, by rotation of the ball 12, it is possible to position the opening 13 in the ball in such a way that it is brought into alignment with the nose-shaped notch 14 in the housing 2 so that orientation is possible extending beyond the range of the opening in the housing 2.

After the desired positioning has been established, the ball 12 is finally clamped by rotation of the foot 16 or the threaded ring 6 (with the assistance of the surface of the metal shell 9) so that the outer wall of the ball 12 is pressed against the upper rim 15 of the housing 2 by the upper face of the metal shell 9. The ball is thus held fixed in the desired position by the resulting engaging pressure.

Figure 5:
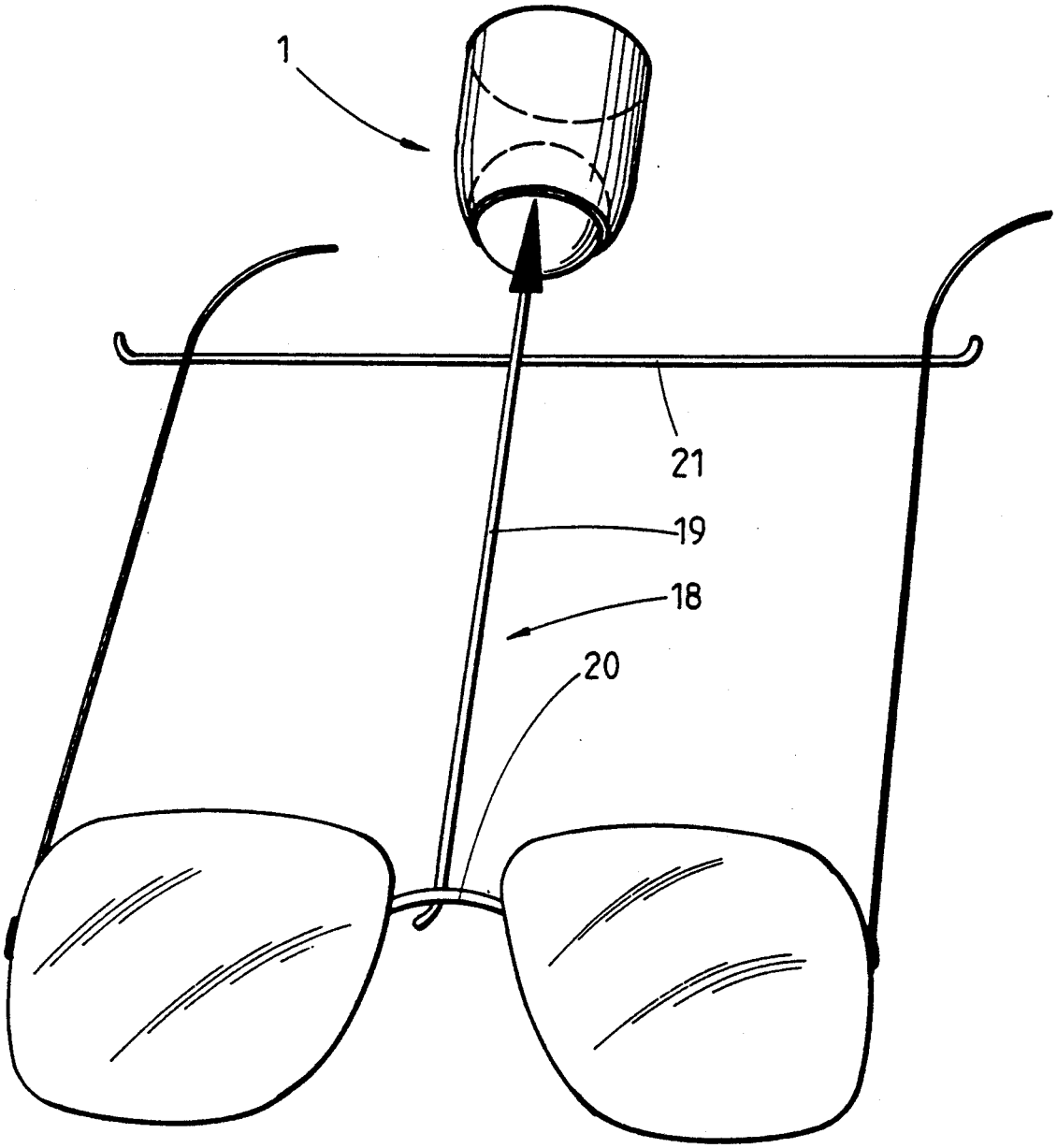
FIG. 5 is a side view of a second embodiment of the holder according to the invention in the horizontal position with a spectacle holding frame and a pair of spectacles mounted on it.

As illustrated in FIG. 5, in a second embodiment now to be described by way of example, it is equally possible to use the retainer 1 for locating a supporting frame 18 which is itself used for displaying a pair of spectacles. The retainer is therefore not used for directly locating a pair of spectacles. As shown in the present example the frame is of cross-like shape, with a central arm 19. The end of the central arm which is towards the retainer 1 is held in the opening 13 and its other end engages under the bridge piece 20 of a pair of spectacles. Arranged transversely with respect to the central arm 19 is a cross-arm 21 the two ends of which engage under respective ear pieces of the spectacles. In this way the spectacles may be displayed in the opened-out state.

The central arm or frame 18 can be connected either detachably or non-detachably to the base retainer 1 or ball 12.

Moreover, it is also possible that, by means of the retainer 1, differently constructed supporting frames could be held. Likewise it is possible to provide the ball not only with a single opening 13 but with several openings.

Although the holder 1 according to the invention has been described above as a holder for spectacle frames or for supporting frames, it is also suitable for displaying components of spectacles, such as lenses or other accessories which are generally displayed and sold in opticians' shops.

What is claimed is:

1. A holder, in particular for spectacle frames, spectacle mounting frames or the like, comprising: an adjusting body; a foot member; and a holder housing; wherein said foot member threadably engages said holder housing to adjustably mount said adjusting body in said holder housing and said adjusting body is arranged to be steplessly adjustable in three dimensions, said adjusting body comprises resiliently yielding material having a receiving socket for resiliently detachably supporting an end of at least one ear piece of a spectacle frame or a spectacle mounting frame, and said foot member is adapted to mount said holder to a support.

2. The holder set forth in claim 1, wherein said adjusting body is arranged to be steplessly adjustable at least in and between two planes.

3. The holder set forth in claim 2, wherein said adjusting body is constructed to be lockable.

4. The holder set forth in claim 1 where said adjusting body is constructed to be lockable.

5. The holder set forth in claim 1 wherein said adjusting body is provided with a spectacle retaining frame detachably mounted in said receiving socket.

6. The holder set forth in claim 1, wherein said foot is arranged coaxially with respect to the central axis of said holder housing and wherein said foot is arranged to be adjustable in height in relation to said holder housing.

7. The holder set forth in claim 1, wherein said foot is provided with a permanent magnet having an engaging surface.

8. The holder set forth in claim 7 wherein said foot has a threaded ring and a shell and said permanent magnet is mounted in said shell.

9. The holder set forth in claim 1 wherein said adjusting body is a pivot joint.

10. The holder set forth in claim 9, wherein said pivot joint is a ball joint.

11. The holder set forth in claim 10, wherein said holder housing includes opposed upper and lower ends, said ball joint comprises a ball arranged in said holder housing, said holder housing being shaped frusto-conically at least at its upper end, said holder housing having an opening at its upper end which at least partially exposes said ball and at least inner edges of said opening in the holder housing are in mutual contact with the surface of said ball.

12. The holder set forth in claim 11 wherein said holder housing has an inner surface including a part-circular shape in the region of said frusto-conical form.

13. The holder set forth in claim 11 wherein said ball is in mutual contact with a face of said foot which is opposite the engaging surface of said foot.

14. The holder set forth in claim 11 wherein said holder housing has a notch penetrating through the wall of said housing and beginning at its edge which forms said opening which exposes said ball, said notch providing external access to said receiving socket when said receiving socket is rotated by more than 90 degrees relative to the central axis of said housing.

15. The holder set forth in claim 14, wherein said notch is in the shape of a nose.

* * * * *